US005590850A

United States Patent [19]

Cannon et al.

[11] Patent Number: 5,590,850

[45] Date of Patent: Jan. 7, 1997

[54] BLENDED MISSILE AUTOPILOT

[75] Inventors: James J. Cannon, Northridge, Calif.; Mark Elkanick, Tucson, Ariz.

[73] Assignee: Hughes Missile Systems Company, Los Angeles, Calif.

[21] Appl. No.: 463,603

[22] Filed: Jun. 5, 1995

[51] Int. Cl.[6] ..... F42B 15/01

[52] U.S. Cl. ..... 244/3.15; 244/3.21

[58] Field of Search ..... 244/3.11, 3.15, 244/3.21, 3.22

[56] References Cited

U.S. PATENT DOCUMENTS

| | | | |
|---|---|---|---|
| 4,171,115 | 10/1979 | Osder | 244/181 |
| 4,589,594 | 5/1986 | Kranz | 244/3.22 |
| 4,624,424 | 11/1986 | Pinson | 244/3.21 |
| 4,830,311 | 5/1989 | Pritchard et al. | 244/3.15 |
| 4,883,239 | 11/1989 | Lachmann et al. | 244/3.15 |
| 5,058,836 | 11/1991 | Nobel | 244/3.15 |
| 5,088,658 | 2/1992 | Forsmo | 244/3.21 |
| 5,439,188 | 8/1995 | Depew, Jr. et al. | 244/3.21 |

OTHER PUBLICATIONS

Blakelock, John H., Automatic Control of Aircraft and Missile, Second Edition. John WIley & sons, Inc.: New York, pp. 233–251 1991.

*Primary Examiner*—Michael J. Carone
*Assistant Examiner*—Theresa M. Wesson
*Attorney, Agent, or Firm*—Charles D. Brown; Randall M. Heald; Wanda K. Denson-Low

[57] ABSTRACT

Blended missile autopilots for a missile employing direct lift and tail controlled autopilots coupled by way of a blending filter. The blended missile autopilots have movable tails aft of the center of gravity of the missile and side force thrusters or movable canards mounted forward of the center of gravity, and that are controlled using the direct lift and tail-controlled autopilots. Lift is generated from the tails and side force is generated by the thrusters or canards, such that the body of the missile maintains zero angle of attack and generates no lift. The present invention thus combines the fast response of a direct lift autopilot with the high acceleration capability of a body lift autopilot, and blends the two using the blending filter to achieve improved performance.

6 Claims, 7 Drawing Sheets

22
21
1 / MASS
1 / VM
NORMALIZED THRUST COMMAND
NORMALIZED THRUST LIMIT
THRUST
L THRUST / I YY
K RCS
TAIL A/P RESPONSE MODEL
"B"
24
DIRECT LIFT LIMIT
K TAIL
N δ
M α
N α
VM
A M
1 / S
1 / S
1 / S
1 / S
M δ
TAIL SERVO
COMMANDED TAIL DEFELCTION
"A"
K b
K θ
K α
K SS
"C"
DIRECT LIFT FEEDFORWARD
A CMD 21
22
24
$A_M$
VM
$N_\alpha$
1 / S
$M_\alpha$
$N_\delta$
$N_{\delta_C}$
$M_{\delta_C}$
$M_\delta$
$K_b$
$K_\theta$
NORMALIZED THRUST COMMAND
CANARD SERVO
TAIL SERVO
COMMANDED TAIL DEFELCTION
"A"
$K_{TAIL}$
$\delta_C$ LIMIT
1
-1
$K_C$
"B"
TAIL A/P RESPONSE MODEL
DIRECT LIFT LIMIT
DIRECT LIFT FEEDFORWARD
$K_\alpha$
"C"
$K_{SS}$
$A_{CMD}$

BLENDED MISSILE AUTOPILOT

BACKGROUND

The present invention relates generally to missile autopilots, and more particularly, to blended missile autopilots comprising a direct lift missile autopilot employing canards or side thrusters and a tail-controlled autopilot.

A tactical missile accelerates normal to its velocity vector in order to maneuver and hit an intended target. Guidance algorithms are used to determine the desired acceleration. An autopilot is then commanded to deliver that acceleration. The term autopilot refers to software and hardware dedicated to delivering the missile acceleration commanded by the guidance algorithms.

The objective of autopilot design is to deliver commanded acceleration as accurately and quickly as possible. Acceleration can be generated aerodynamically via lift, or less commonly, via thrusters oriented normal to the missile longitudinal axis. Aerodynamic autopilots fall into four basic categories. These include tail controlled autopilots, autopilots having fixed tails with movable wing surfaces, canard controlled autopilots, and autopilots having a combination of movable tails and canards.

Tail controlled autopilots have movable control surfaces (tails) located at the aft end of the body of the missile, aft of the center of gravity. The tails are used to generate pitching moments. As the body is pitched, the resulting angle of attack generates body lift, providing the desired acceleration. Fixed wings may be used forward of the tails for improved lifting capabilities.

In an autopilot having fixed tails with movable wings, the wings are located near the missile center of gravity. The wings are pitched to directly generate lift, while the body remains at low angles of attack, generating little lift. The fixed tail surfaces provide pitching moments which tend to restore the body to zero angle-of-attack.

Canard controlled autopilots operate in a manner similar to tail controlled autopilots. The canards are mounted forward of the center of gravity, and are used to generate pitching moments, and angle-of-attack of the body of the missile. Fixed wings mounted aft of the canards are used to generate lift.

With direct lift autopilots employing both movable tails and canards, the pitching moments from forward mounted canards are balanced against the pitching moments of the aft mounted tails.

Each autopilot type has distinct advantages. Where high acceleration capability is needed, autopilots employing body lift (tail or canard control) are desirable since the body is capable of generating significantly more lift than relatively small, movable control surfaces, thrusters, or canards. Where very fast response time is required, direct lift autopilots are desirable, since the control surfaces or thrusters can generate lift much faster than the body of the missile, and thus generate lift more quickly.

With regard to other prior art, it is known that several Soviet missile designs employ movable tails and canards, but nothing is known about the autopilot designs used therein.

Accordingly, it is an objective of the present invention to provide for improved blended missile autopilots comprising a direct lift missile autopilot employing canards or side thrusters and a tail-controlled autopilot.

SUMMARY OF THE INVENTION

To meet the above and other objectives of the present invention provides for blended missile autopilots that include a direct lift missile autopilot having canards or side thrusters coupled to a tail-controlled autopilot. The blended missile autopilots employ movable tails aft of the center of gravity of the missile and lateral force generating members comprising either side force thrusters or movable canards mounted forward of the center of gravity of the missile, and are controlled using direct lift and tail-controlled autopilots. Lift is generated from the tails and side force is generated by the thrusters or canards, such that the body of the missile maintains zero angle of attack and generates no lift. The present invention thus combines the fast response of a direct lift autopilot with the high acceleration capability of a body lift autopilot, and blends the two to achieve improved performance.

More particularly, the blended missile autopilot comprises a missile having a body that houses a plurality of rotatable tails aft of its center of gravity and a plurality of actuatable lateral force generating members forward of the center of gravity, and a plurality of controllable actuators coupled to the tails and lateral force generating members. A controller is coupled to the plurality of actuators that implements a predetermined transfer function comprising a tail controlled autopilot for controlling the tails and a direct lift autopilot for controlling the lateral force generating members. One key aspect of the present autopilot is that the direct lift autopilot is coupled to the tail controlled autopilot by means of a blending filter.

The present invention provides tactical missiles with extremely fast autopilot response while preserving high acceleration capability. In one embodiment, fast autopilot response is achieved using forward mounted thrusters oriented normal to the missile longitudinal axis in combination with aft mounted tail control surfaces. In a second embodiment, fast autopilot response is achieved using forward mounted aerodynamic control surfaces and actuators in combination with the aft mounted tail control surfaces. Because of missile packaging constraints and the desire to minimize weight, thruster propellant supply is limited, and is managed carefully during an engagement, and is optimally reserved for the final seconds prior to impact. Consequently, a tail controlled autopilot is employed in the present invention and provides control until the thrusters or canards are activated. Using thrusters or canards in the manner of the present invention allows the autopilots to be effective at higher altitudes than those that rely on aerodynamic control only.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1A:
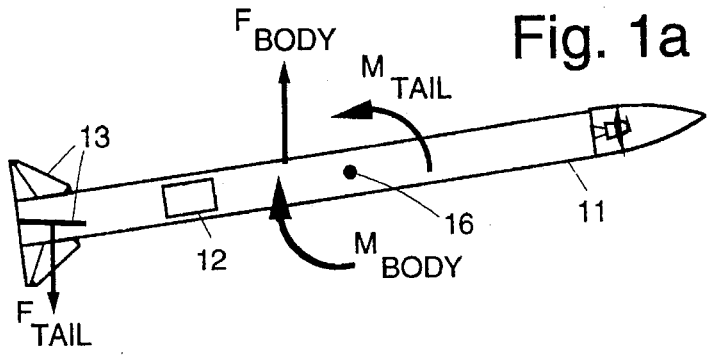
FIGS. 1*a*–1*c* illustrate conventional autopilot schemes that are useful in understanding the improvements provided by the present invention.
Figure 1B:
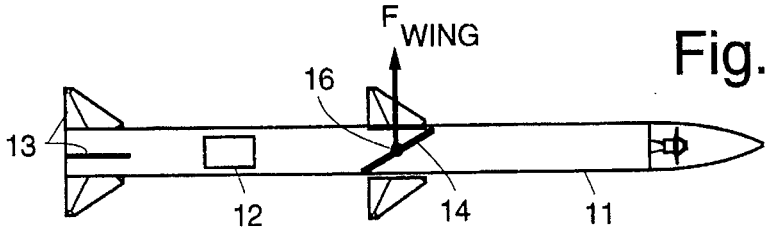
Figure 1C:
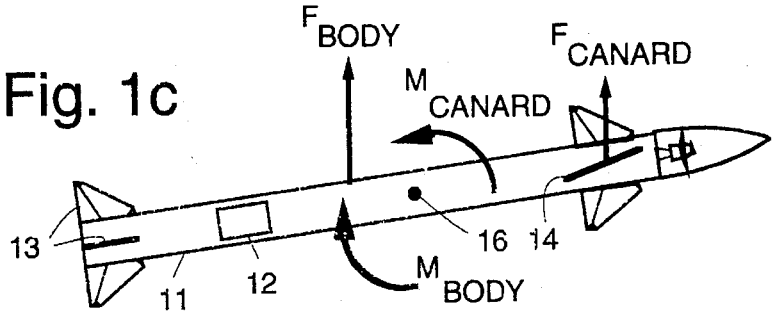

Referring to the drawing figures, FIGS. 1*a*–1*c* illustrate conventional autopilots for a missile 11 that are useful in understanding the improvements provided by the present invention. FIG. 1*a* shows a conventional tail controlled autopilot 10 that comprises a controller 12 that controls the motion of tails 13 located aft of the center of gravity 16 of the missile 11. The relative motion (M) of the missile 11 about the center of gravity 16 due to forces (F) exerted by the body of the missile and tail 13 are also shown in FIG. 1*a*. FIG. 1*b* shows a conventional wing controlled autopilot that comprises a controller 12 that controls the motion of wings 13 located at the center of gravity 16 of the missile 11. The forces (F) exerted by the wings 14 are also shown in FIG. 1*b*. FIG. 1*c* shows a conventional canard controlled autopilot that comprises a controller 12 that controls the motion of canards 14 located forward of the center of gravity 16 of the missile 11. The relative motion (M) of the missile 11 about the center of gravity 16 due to forces (F) exerted by the body of the missile and canard 14 are also shown in FIG. 1*c*.

Figure 1D:
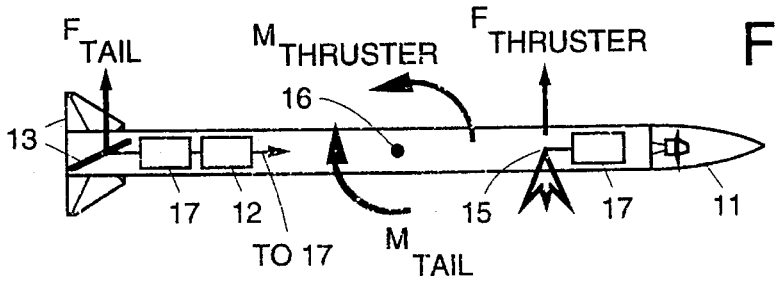
FIGS. 1*d* and 1*e* illustrate autopilot schemes in accordance with the principles of the present invention.

Referring to FIG. 1*d*, it illustrates a first embodiment of a blended missile autopilot in accordance with the principles of the present invention. The missile autopilot comprises a controller 12, a plurality of rotatable tails 13 mounted aft of the center of gravity of the missile 11, and a plurality of actuatable lateral force generating members comprising a plurality of thrusters 15 mounted forward of the center of gravity 16 of the missile 11. A plurality of controllable actuators 17 are coupled to the tails 13 and thrusters 15. The plurality of rotatable tails 13 and thrusters 15 are controlled by way of the actuators 17 using the controller 12. The controller 12 implements a predetermined transfer function to operate the actuators 17 as will be described below. Thus, the present autopilot comprises a tail controlled autopilot 21 for controlling movement of the tails 13 in combination with the direct lift autopilot 22 for controlling the plurality of thrusters 15.

Figure 2:
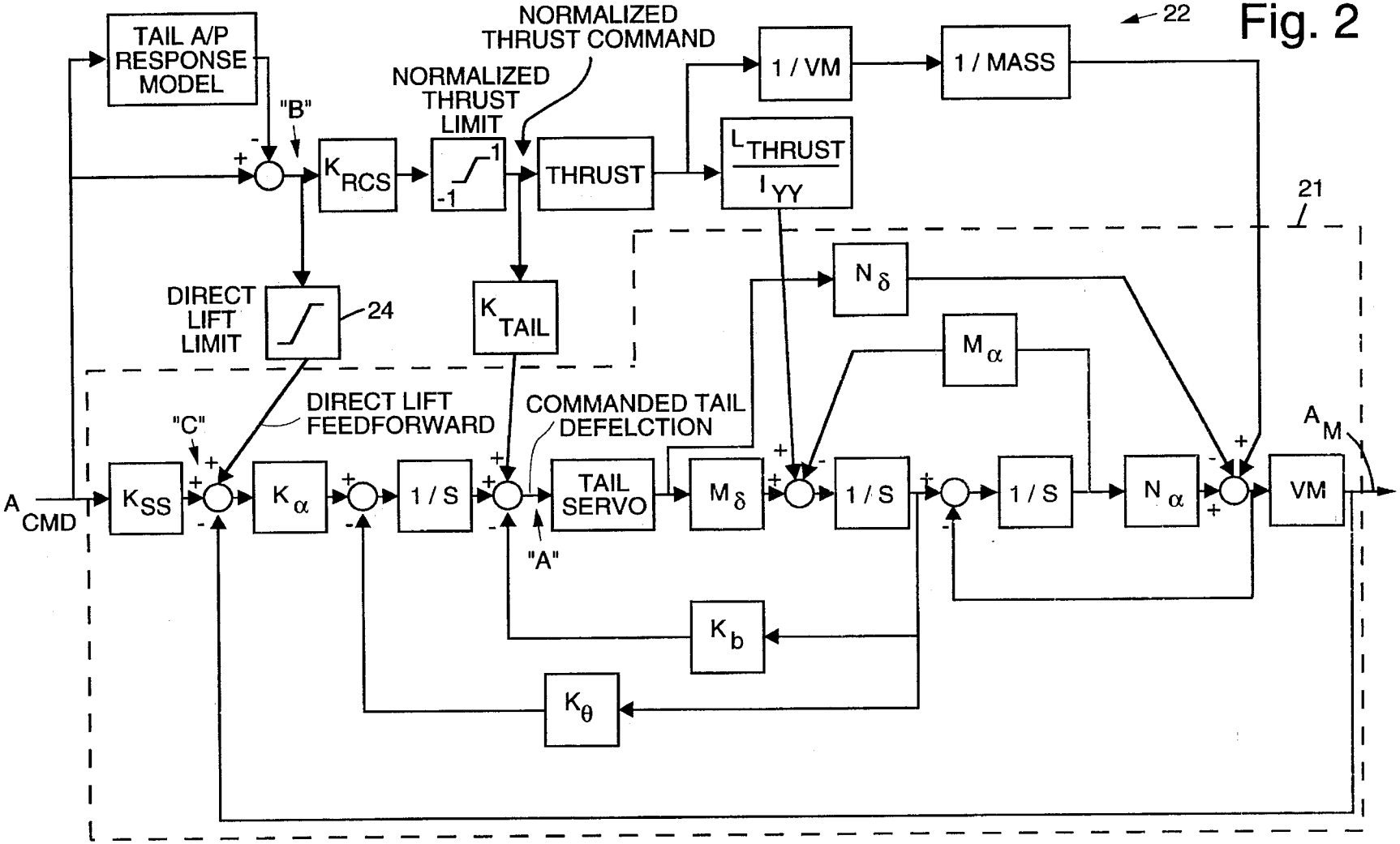
FIG. 2 shows a first embodiment of a blended direct lift, thruster and tail controlled autopilot in accordance with the principles of the present invention corresponding to the embodiment shown in FIG. 1*d;*

FIG. 2 shows a detailed block diagram of a linearized closed loop transfer function for the blended missile autopilot of FIG. 1*d*. The tall-controlled autopilot 21 is enclosed in the dashed box shown in FIG. 2, and the direct lift autopilot and blending scheme in accordance with the principles of the present invention is the balance of FIG. 2. The designs of the tail-controlled autopilot 21, the direct lift autopilot 22, and the blending mechanism are discussed below.

The tail-controlled autopilot 21 operates to turn the tails 13 of the missile 11 to create pitching moment on the body of the missile 11, which generates missile angle-of-attack, resulting in lift. At the angle of attack where desired acceleration is achieved, the pitching moment generated by the tails 13 is equal and opposite to the pitching moment generated by the body of the missile 11, and the missile 11 is trimmed.

The linearized closed loop transfer function of the tail-controlled autopilot 21 is:

$$\frac{A}{A_{CMD}} = \frac{K_{ss}K_aV_m\left(M_\delta N_\alpha - M_\alpha N_\delta - \frac{s^2}{N_\delta}\right)}{s^3 + N_\alpha + M_\alpha K_b - K_aV_mN_\delta s^2 + (M_\alpha + (M_\delta N_\alpha - M_\alpha N_\delta)K_b + K_\theta M_\delta s + (K_aV_m + K_\theta)(M_\delta N_\alpha - M_\alpha N_\delta)}$$

where $$M_\alpha = \frac{q\,S_{ref}\,d\,C_{m\alpha}}{I_{yy}},\quad N_\alpha = \frac{q\,S_{ref}\,C_{n\alpha}}{m\,V_m},$$

$$M_\delta = \frac{q\,S_{ref}\,d\,C_{m\delta}}{I_{yy}},\ \text{and}\ N_\delta = \frac{q\,S_{ref}\,C_{n\delta}}{m\,V_m},$$

and s is the Laplace operator, $K_{ss}$ is a steady state gain correction term, $\alpha$ is angle-of-attack, $\delta(=\delta_T)$ is tail deflection angle, q is dynamic pressure, $S_{ref}$ is aerodynamic reference area, d is an aerodynamic reference length, m is the mass of the missile 11, $V_m$ is velocity of the missile 11, $I_{yy}$ is pitch moment of inertia, $C_{m\alpha}$ is moment derivative with respect to angle-of-attack, $C_{n\alpha}$ is a normal force derivative with respect to angle-of-attack, $C_{m\delta}$ is a moment derivative with respect to tail deflection, and $C_{n\delta}$ is a normal force derivative with respect to tail deflection.

Gains $K_a$, $K_b$, and $K_\theta$ are chosen to provide fast, well damped response. One suitable choice of closed loop poles (neglecting actuator effects) is:

$$p_{1,2} = -0.7\omega \pm 0.7\omega j,\ \text{and}\ p_3 = -0.7\omega.$$

Equating coefficients with the desired closed loop transfer function:

$$\frac{A}{A_{cmd}} = \frac{.7\omega^3\left(1 - \frac{s^2}{z^2}\right)}{s^3 + 3(.7)\omega s^2 + (\omega^2 + 2\,(.7)^2\omega^2)s + .7\omega^3} \tag{1}$$

where z is the z transform operator, and $\omega$ is the bandwidth of the autopilot 21. $K_a$, $K_b$, and $K_\theta$ can be calculated:

$$K_b = \frac{\frac{(.7)\omega^3}{M_\delta N_\alpha - M_\alpha N_\delta} - \frac{2\omega^2}{M_\delta} - \frac{N_\alpha}{N_\delta} + \frac{3(.7)\omega}{N_\delta} + \frac{M_\alpha}{M_\delta}}{\frac{M_\delta}{N_\delta} - \frac{M_\delta N_\alpha - M_\alpha N_\delta}{M_\delta}}$$

$$K_\theta = \frac{2\omega^2 - M_\alpha - K_b(M_\delta N_\alpha - M_\alpha N_\delta)}{M_\delta}$$

$$K_a = \frac{(.7)\omega^3 - K_\theta(M_\delta N_\alpha - M_\alpha N_\delta)}{V_m(M_\delta N_\alpha - M_\alpha N_\delta)}$$

Zeroes of the closed loop transfer function are not controlled. The bandwidth (ω) of the autopilot 21 is set as large as stability allows.

With reference to FIGS. 1*d* and 2, in the first embodiment of the present invention, the blended missile autopilot uses both tails 13 and thrusters 15 to generate force normal to the body of the missile 11, and balance opposing pitching moments, keeping the body of the missile 11 unrotated. The normal force is generated as fast as actuators for the tails 13 and thrusters 15 allow, much faster than the body of the missile 11 can rotate and produce lift, yielding an extremely fast autopilot. The tail-controlled autopilot 21 is used to control disturbance torques, such as those generated by wind gusts, or aerodynamic unbalances.

$K_{TAIL}$ is a proportionality constant between commanded thrust and the direct lift portion of the tall commands. $K_{TAIL}$ is calculated to balance pitching moments due to tails 13 and thrusters 15.

$$K_{TAIL} M_\delta = \frac{TL}{I_{yy}}$$

$$\delta = K_{TAIL}\, \partial_{RCS}$$

$\partial_{RCS}$ is the normalized commanded thrust. The total direct lift acceleration is:

$$A_{DL} = V_m N_\delta\, \delta + \frac{T}{m}\, \partial_{RCS} = \left( V_m N_\delta\, K_{TAIL} + \frac{T}{m} \right) \partial_{RCS}$$

where T is the maximum available side thrust and L is the thruster moment arm. The tail deflection command provided by the direct lift autopilot 22 is summed with the deflection command of the tail-controlled autopilot tail 21 at location "A" in FIG. 2.

The blending mechanism used to transition from the direct lift autopilot 22 to the tail-controlled autopilot 21 is designed to take full advantage of the fast response of direct lift autopilot 22. The blending mechanism comprises the use of a blending filter coupled between the direct lift autopilot 22 and the tail-controlled autopilot 21. Normal force generated by the tails 13 and thrusters 15 is replaced by lift generated by the body of the missile 11 as fast as the tail-controlled autopilot 21 allows resulting in a smooth step response. The blending filter 24 also allows graceful degradation to the tail-controlled autopilot 21 when the commanded acceleration is greater than the tails 13 and thrusters 15 can deliver.

The autopilot blending mechanism implemented in the present invention is to command the direct lift autopilot 22 to deliver precisely the commanded acceleration less what the tail controlled autopilot 21 delivers. This is accomplished in open loop fashion using the blending filter 24 illustrated in FIG. 2. The blending filter 24 is a very precise model of the response of the tail-controlled autopilot 21. Location "B" in FIG. 2 indicates where the estimate of the acceleration derived from the tail-controlled autopilot 21 is subtracted from the total acceleration command, leaving the net direct lift acceleration command. The blending filter 24 is a digital implementation of the desired closed loop response of the tail-controlled autopilot 21 given by Equation (1) above. Both poles and zeroes are modeled.

An important innovation of this design is the feedforward of the direct lift acceleration command into the tail-controlled autopilot 21 shown at location "C" in FIG. 2. This causes the tail-controlled autopilot 21 to perform as if it is acting alone. Without feedforward of the direct lift acceleration command, the blending filter 24 could not properly match the response of the tail controlled autopilot 21, and the overall response of the autopilot would be degraded.

Figure 3:
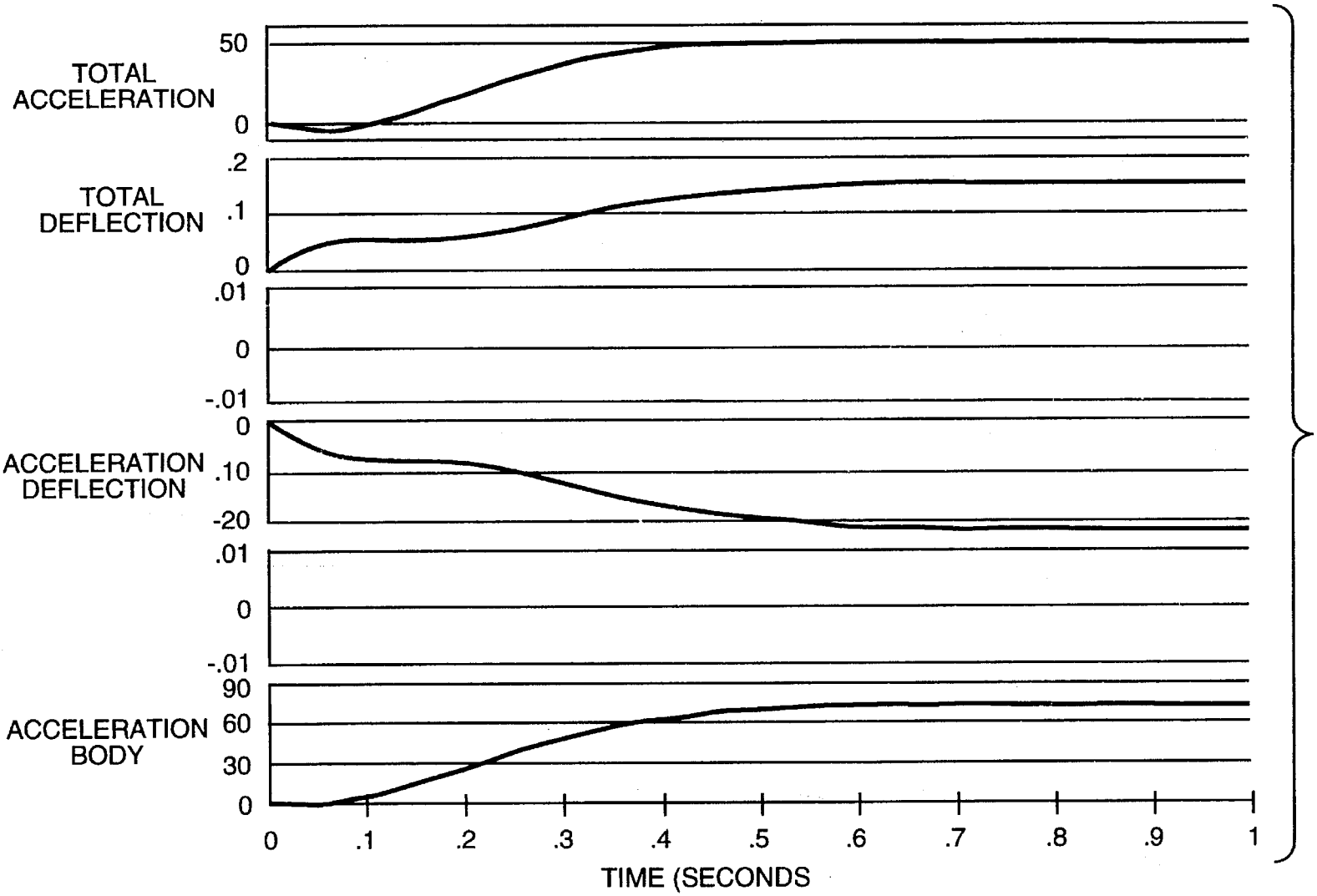
FIG. 3 shows the step response achieved by the conventional tail controlled autopilot of FIG. 1*a;*
Figure 4:
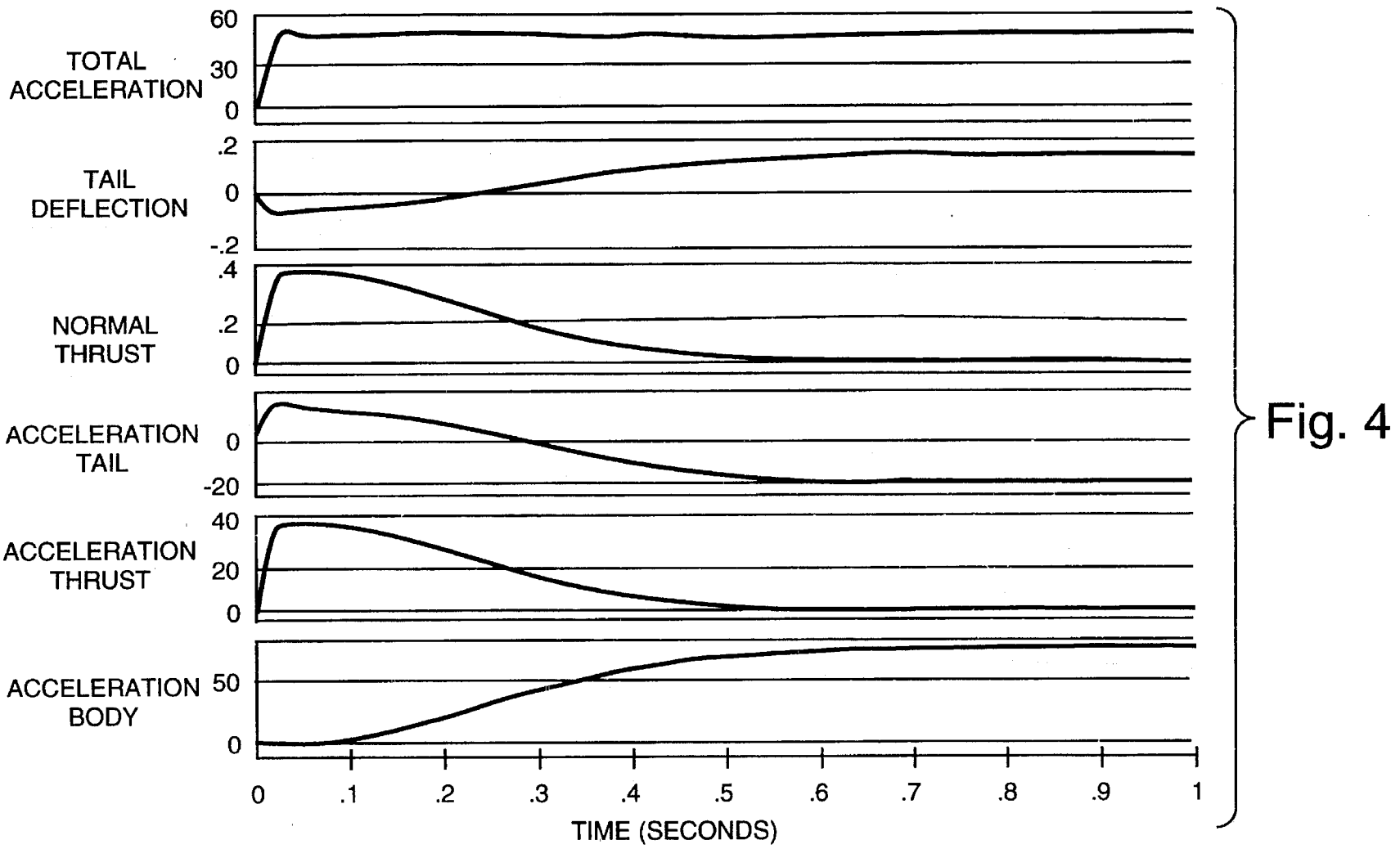
FIG. 4 shows the step response achieved by the blended thruster and tail controlled autopilot of FIGS. 1*d* and 2.

Linear, single plane simulation results for the first embodiment of the present invention are shown in FIGS. 3 and 4. FIG. 3 shows the step response for a conventional tail-controlled autopilot shown in FIG. 1*a*. Aerodynamics and flight conditions used are typical of ground and air launched tactical missiles 11. FIG. 4 shows the step response for the blended direct lift, tail-controlled autopilot 21 of FIGS. 1*d* and 2. Flight conditions are identical. Comparing the first graph in FIGS. 3 and 4, the benefits of direct lift are striking. The commanded acceleration is achieved in a fraction of the time required for the tail-controlled autopilot of FIG. 1*a*. The fourth, fifth, and sixth graphs indicate the contributions to total acceleration from tails 13, thrusters 15, and body of the missile 11. A smooth transition from tail/thruster lift to body lift is effected by the blending mechanism. The thrust level returns to zero (third graph) and the thrusters 15 are available for further maneuvers.

Figure 1E:
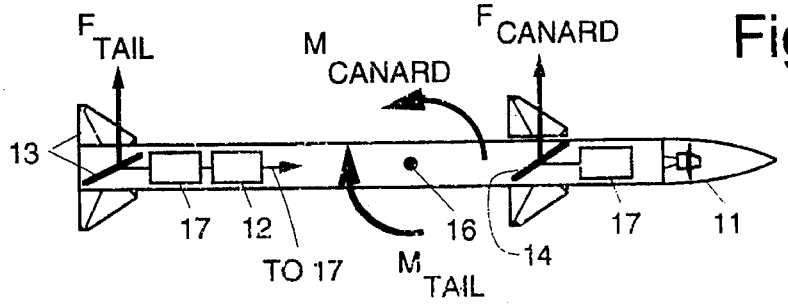
Figure 5:
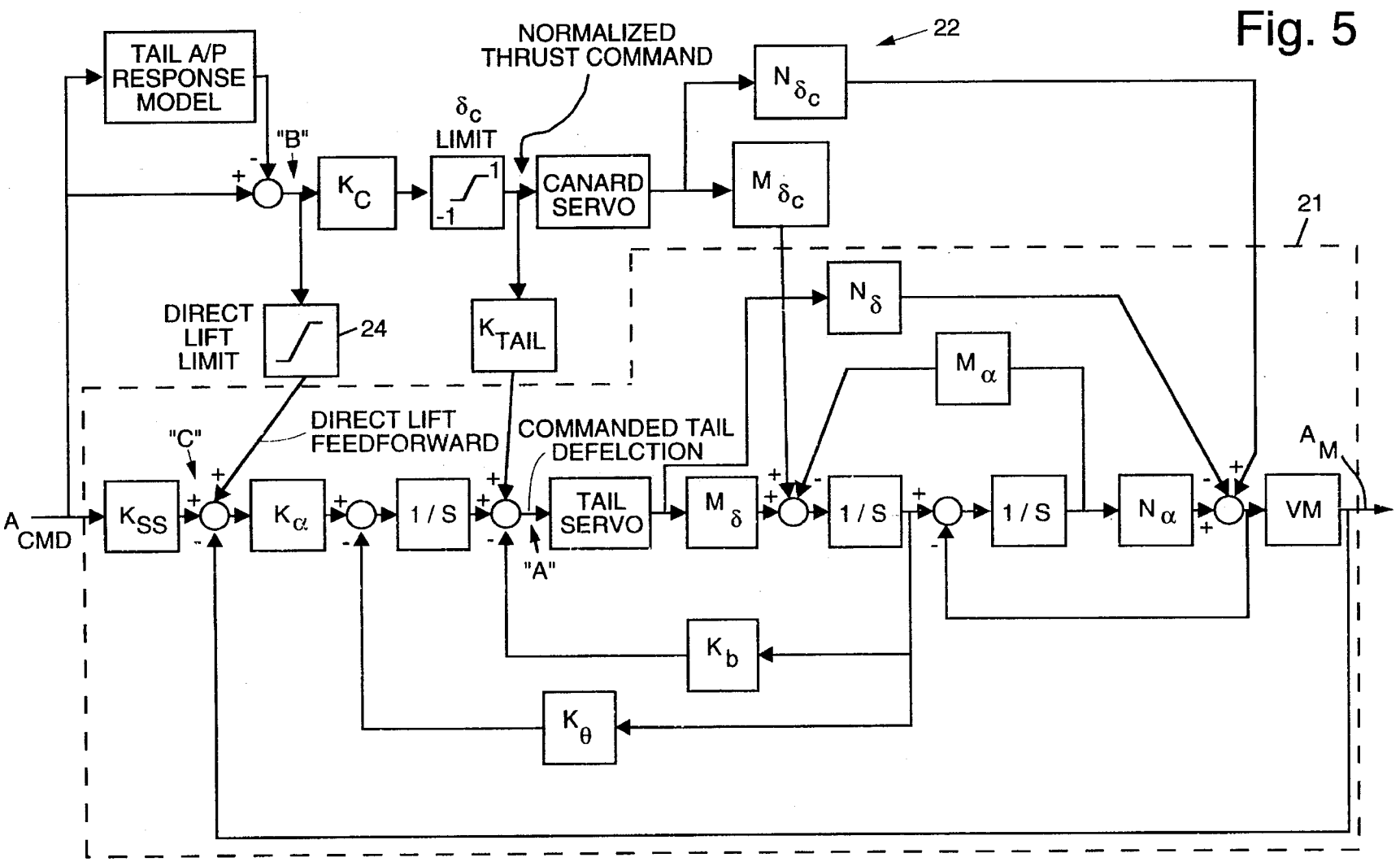
FIG. 5 shows a second embodiment of a blended direct lift, canard and tail controlled autopilot in accordance with the principles of the present invention corresponding to the embodiment shown in FIG. 1*e;*

With reference to FIG. 5, in the second embodiment of the present invention is shown. The second embodiment is substantially the same as the first embodiment, but with differences as are described below. More particularly, FIG. 5 shows a blended direct lift, tail controlled autopilot corresponding to the embodiment shown in FIG. 1*e*. The second embodiment of the direct lift autopilot 21 uses tails 13 and canards 14 (actuatable lateral force generating members 14) to generate lift, and balance opposing pitching moments, keeping the body of the missile 11 unrotated. The lift from control surfaces (tails 13 and canards 14) is generated as fast as their actuators allow, yielding an extremely fast autopilot.

The equations for the basic transfer function for the second embodiment of the blended missile autopilot is as presented above with reference to FIG. 2. However, in this second embodiment, $K_{tail}$ is the proportionality constant between direct lift canard commands and the direct lift portion of the tail commands. $K_{tail}$ is calculated to balance pitching moments due to tails and canards.

$$K_{tail} M_\delta = M_{\delta_C}$$

$$\delta = K_{tail}\, \delta C$$

The direct lift acceleration is:

$$A_{DL} = V_m(N_\delta \delta + N_{\delta_C} \delta C) = V_m(N_\delta K_{tail} \delta_C + N_{\delta_C} \delta C)$$

where $$M_{\delta_C} = \frac{q\, S_{ref}\, d\, C_{m_{\delta_C}}}{I_{yy}}$$

$$N_{\delta_C} = \frac{q\, S_{ref}\, C_{n_{\delta_C}}}{m\, V_m}$$

and $\delta_C$ is the canard deflection angle, $C_{m\delta_C}$ is the moment derivative with respect to canard deflection, $C_{n\delta_C}$ is the normal force derivative with respect to canard deflection, and $K_C$ is the proportionality constant between direct lift acceleration and canard deflection:

$$K_C = \frac{\delta_C}{A_{DL}} = \frac{1}{V_m\,(N_\delta K_{tail} + N_{\delta_C})}$$

The direct lift portion of the tail deflection command is summed with the tail-controlled autopilot tall deflection command at location "A" in FIG. 5.

The blending mechanism used to transition from the direct lift autopilot 22 to the tail-controlled autopilot 21 comprises the blending filter 24 that is coupled between the direct lift autopilot 22 and the tail-controlled autopilot 21. Lift generated by the tails 13 and canards 14 is replaced by lift generated by the body of the missile 11 as fast as the tail-controlled autopilot 21 allows resulting in a smooth step response. The blending filter 24 also allows graceful degradation to the tail-controlled autopilot 21 when commanded accelerations are greater than tail and canard lift can generate.

The implementation of autopilot blending is to command the direct lift autopilot 22 to precisely deliver the commanded acceleration less what the tail-controlled autopilot 21 delivers. This is accomplished in open loop fashion using the blending filter 24 illustrated in FIG. 5. Location "B" in FIG. 5 indicates where the estimate of the acceleration derived from the tail-controlled autopilot 21 is subtracted from the total acceleration command leaving the net direct lift acceleration command. The blending filter 24 is a digital implementation of the desired closed loop autopilot response given by Equation (1). Both poles and zeroes are modeled.

Feedforward of the direct lift acceleration command into the tail-controlled autopilot 21 at location "C" in FIG. 5 causes the tail-controlled autopilot 21 to perform as if it is acting alone. Without the feedforward, the blending filter 24 could not properly match the tail controlled response, and the overall response of the autopilot would be degraded.

For the direct lift autopilot 22 to generate lift without pitching the missile 11, the proportionality relationship, $$\delta_T = K_{tail}\delta_C$$

must be maintained throughout the angular excursion of the tails 13 and canards 14. This means that any angular position limits, either hardware constraints or aerodynamic effectiveness constraints, imposed on one set of control surfaces, must be imposed on the other set. Assuming that the canards 14 reach their limit first, $$[\delta_T]_{LIM} = K_{tail}[\delta_C]_{LIM}.$$

This limit applies to the direct lift portion of the tail command only. Similarly, rate limits imposed on one set of control surfaces (tails 13 and canards 14) must be applied to the other set in proportion:

$$[\dot{\delta}_T]_{LIM} = K_{tail}[\dot{\delta}_C]_{LIM}.$$

Figure 6:
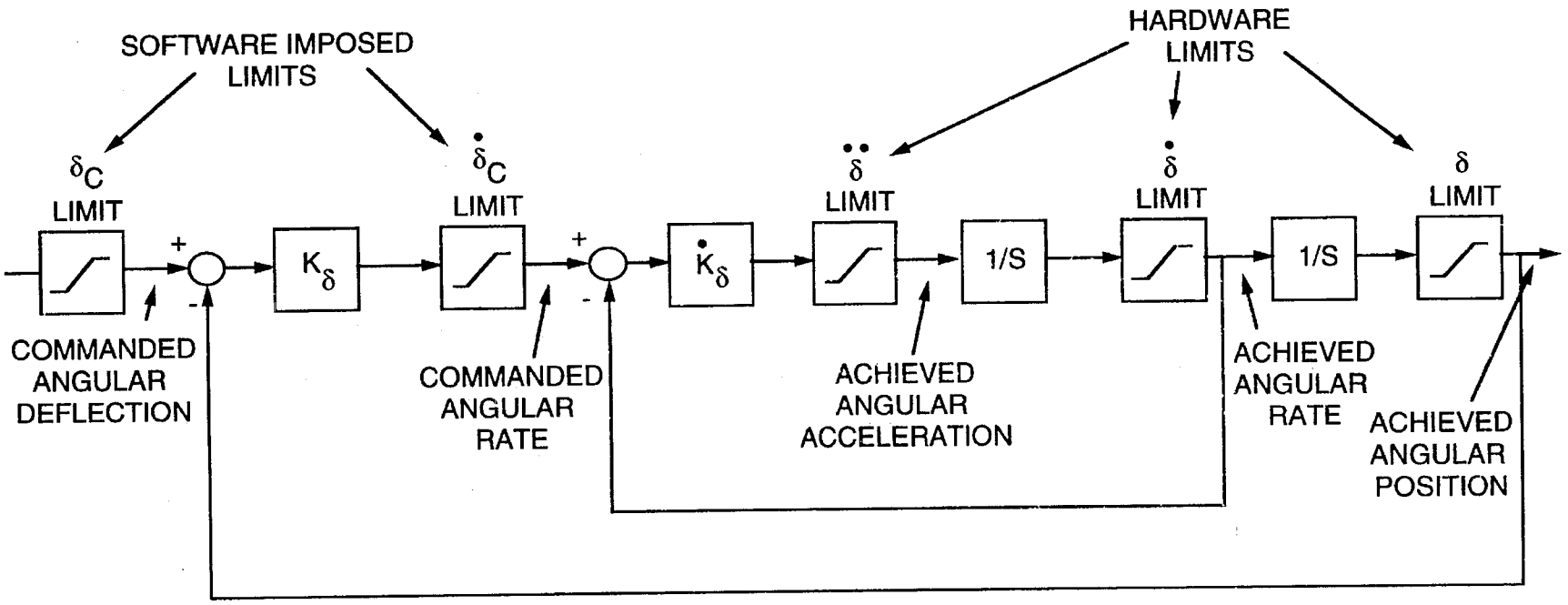
FIG. 6 shows a block diagram of an actuator model employed in the autopilot of FIG. 5 illustrating software position and rate limiters.

FIG. 6 shows a block diagram of an actuator model employed in the controller 12 of the autopilot of FIG. 5 illustrating software position and rate limiters.

Figure 7:
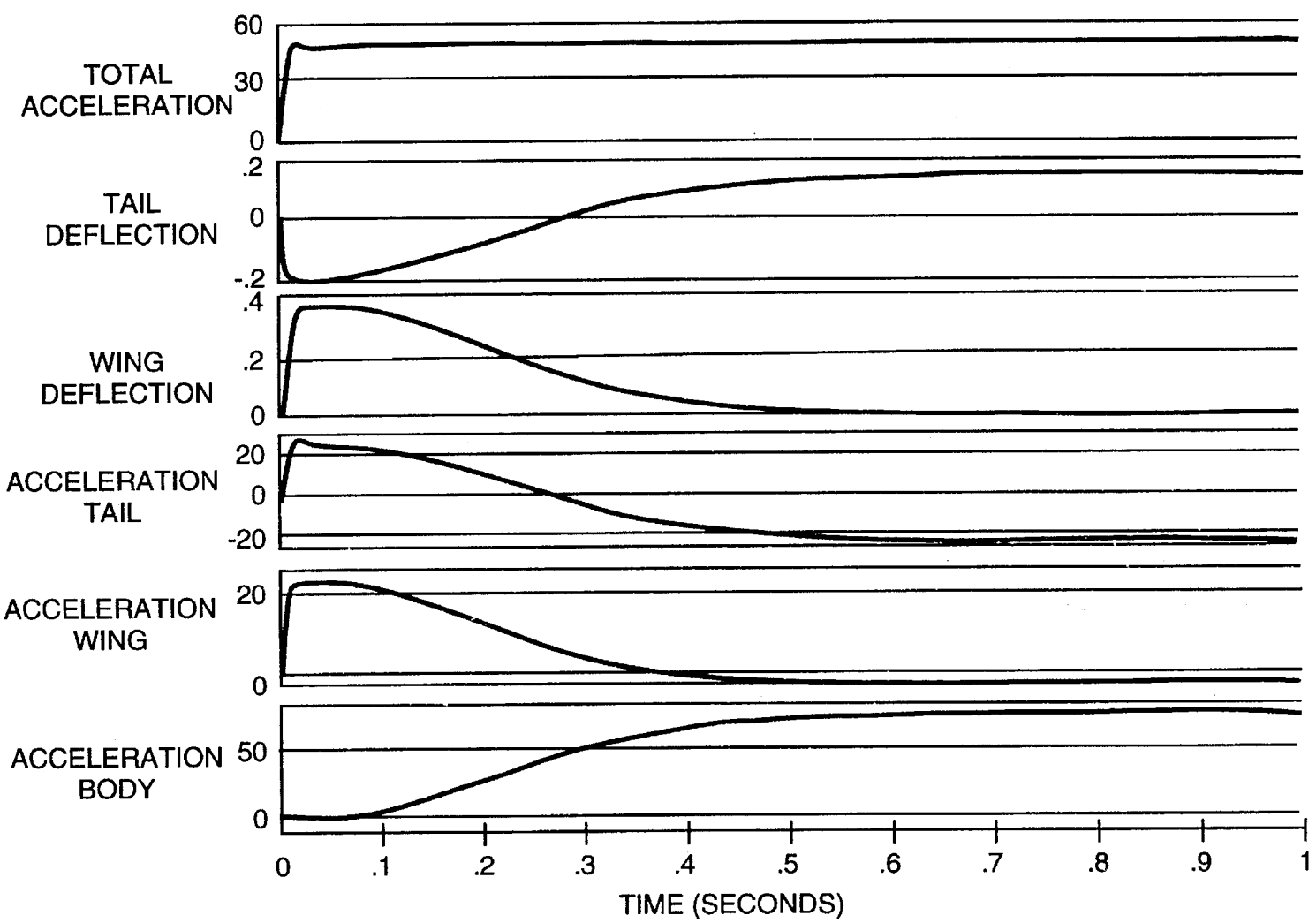
FIG. 7 shows the step response achieved by the blended thruster and tail controlled autopilot of FIGS. 1*e* and 5.

FIG. 7 shows simulation results from a linear single plane simulation similar to those shown in FIGS. 3 and 4. FIG. 7 shows a step response for the blended direct lift, tail-controlled autopilot at flight conditions identical to those of FIGS. 3 and 4. Aerodynamics have been modified to include canard effects. Comparing the first graphs of FIGS. 3 and 7, the benefits of direct lift are clear. The commanded acceleration is achieved in a fraction of the time required for the tail-controlled configuration. The fourth, fifth, and sixth charts indicate the contributions to total acceleration from tails 13, canards 14, and body of the missile 11. A smooth transition from tail/canard lift to body lift is effected by the blending filter 24. Canard angle deflections are returned to zero (third graph) and the canards 14 are available for further maneuvers.

Thus, new and improved blended missile autopilots comprising a direct lift missile autopilot to control canards or side thrusters and a tail-controlled autopilot to control tails have been disclosed. It is to be understood that the described embodiments are merely illustrative of some of the many specific embodiments which represent applications of the principles of the present invention. Clearly, numerous and other arrangements can be readily devised by those skilled in the art without departing from the scope of the invention.

What is claimed is:

1. A blended missile autopilot comprising:

a missile comprising a body, a plurality of rotatable tails disposed on the body aft of its center of gravity, a plurality of actuatable lateral force generating members disposed on the body forward of the center of gravity, and a plurality of controllable actuators coupled to the tails and lateral force generating members; and a controller coupled to the plurality of actuators for the tails and lateral force generating members that implements a predetermined transfer function comprising a tail controlled autopilot for controlling the tails and a direct lift autopilot for controlling the lateral force generating members, and wherein the direct lift autopilot is coupled to the tail controlled autopilot by means of a blending filter.

2. The controller of claim 1 wherein the predetermined transfer function is implemented in accordance with the equation:

$$\frac{A}{A_{CMD}} = \frac{K_{ss}K_aV_m\left(M_\delta N_\alpha - M_\alpha N_\delta - \frac{s^2}{N_\delta}\right)}{s^3 + N_\alpha + M_\alpha K_b - K_aV_mN_\delta s^2 + (M_\alpha + (M_\delta N_\alpha - M_\alpha N_\delta)K_b + K_\theta M_\delta s + (K_aV_m + K_\theta)(M_\delta N_\alpha - M_\alpha N_\delta)}$$

where $$M_\alpha = \frac{q\,S_{ref}\,d\,C_{m\alpha}}{I_{yy}},\ N_\alpha = \frac{q\,S_{ref}\,C_{n\alpha}}{m\,V_m},$$

$$M_\delta = \frac{q\,S_{ref}\,d\,C_{m\delta}}{I_{yy}},\ \text{and}\ N_\delta = \frac{q\,S_{ref}\,C_{n\delta}}{m\,V_m},$$

and s is the Laplace operator, $K_{ss}$ is a steady state gain correction term, $\alpha$ is angle-of-attack, $\delta(=\delta_T)$ is tail deflection angle, q is dynamic pressure, $S_{ref}$ is aerodynamic reference area, d is an aerodynamic reference length, m is the mass of the missile, $V_m$ is velocity of the missile, $I_{yy}$ is pitch moment of inertia, $C_{m\alpha}$ is moment derivative with respect to angle-of-attack, $C_{n\alpha}$ is a normal force derivative with respect to angle-of-attack, $C_{m\delta}$ is a moment derivative with respect to tail deflection, and $C_{n\delta}$ is a normal force derivative with respect to tail deflection.

3. A blended missile autopilot comprising:

a missile comprising a body, a plurality of rotatable tails disposed on the body aft of its center of gravity, a plurality of thrusters disposed on the body forward of the center of gravity, and a plurality of controllable actuators coupled to the tails and thrusters; and a controller coupled to the plurality of actuators for the tails and thrusters that implements a predetermined transfer function comprising a tail controlled autopilot for controlling the plurality of tails and a direct lift autopilot for controlling the plurality of thrusters and wherein the direct lift autopilot is coupled to the tall controlled autopilot by means of a blending filter.

4. The controller of claim 3 wherein the predetermined transfer function is implemented in accordance with the equation:

$$\frac{A}{A_{CMD}} = \frac{K_{ss}K_aV_m\left(M_\delta N_\alpha - M_\alpha N_\delta - \frac{s^2}{N_\delta}\right)}{s^3 + N_\alpha + M_\alpha K_b - K_aV_mN_\delta s^2 + (M_\alpha + (M_\delta N_\alpha - M_\alpha N_\delta)K_b + K_\theta M_\delta s + (K_aV_m + K_\theta)(M_\delta N_\alpha - M_\alpha N_\delta)}$$

where $$M_\alpha = \frac{q\,S_{ref}\,d\,C_{m\alpha}}{I_{yy}},\ N_\alpha = \frac{q\,S_{ref}\,C_{n\alpha}}{m\,V_m},$$

$$M_\delta = \frac{q\,S_{ref}\,d\,C_{m\delta}}{I_{yy}},\ \text{and } N_\delta = \frac{q\,S_{ref}\,C_{n\delta}}{m\,V_m},$$

and s is the Laplace operator, $K_{ss}$ is a steady state gain correction term, $\alpha$ is angle-of-attack, $\delta(=\delta_T)$ is tail deflection angle, q is dynamic pressure, $S_{ref}$ is aerodynamic reference area, d is an aerodynamic reference length, m is the mass of the missile, $V_m$ is velocity of the missile, $I_{yy}$ is pitch moment of inertia, $C_{m\alpha}$ is moment derivative with respect to angle-of-attack, $C_{n\alpha}$ is a normal force derivative with respect to angle-of-attack, $C_{m\delta}$ is a moment derivative with respect to tail deflection, and $C_{n\delta}$ is a normal force derivative with respect to tail deflection.

5. A blended missile autopilot comprising:

a missile comprising a body, a plurality of rotatable tails disposed on the body aft of its center of gravity, a plurality of canards disposed on the body forward of the center of gravity, and a plurality of controllable actuators coupled to the tails and canards; and a controller coupled to the plurality of actuators for the tails and canards that implements a predetermined transfer function comprising a tail controlled autopilot for controlling the plurality of tails and a direct lift autopilot for controlling the plurality of canards and wherein the direct lift autopilot is coupled to the tail controlled autopilot by means of a blending filter.

6. The controller of claim 5 wherein the predetermined transfer function is implemented in accordance with the equation:

$$\frac{A}{A_{CMD}} = \frac{K_{ss}K_aV_m\left(M_\delta N_\alpha - M_\alpha N_\delta - \frac{s^2}{N_\delta}\right)}{s^3 + N_\alpha + M_\alpha K_b - K_aV_mN_\delta s^2 + (M_\alpha + (M_\delta N_\alpha - M_\alpha N_\delta)K_b + K_\theta M_\delta s + (K_aV_m + K_\theta)(M_\delta N_\alpha - M_\alpha N_\delta)}$$

where $$M_\alpha = \frac{q\,S_{ref}\,d\,C_{m\alpha}}{I_{yy}},\ N_\alpha = \frac{q\,S_{ref}\,C_{n\alpha}}{m\,V_m},$$

$$M_\delta = \frac{q\,S_{ref}\,d\,C_{m\delta}}{I_{yy}},\ \text{and } N_\delta = \frac{q\,S_{ref}\,C_{n\delta}}{m\,V_m},$$

and s is the Laplace operator, $K_{ss}$ is a steady state gain correction term, $\alpha$ is angle-of-attack, $\delta(=\delta_T)$ is tail deflection angle, q is dynamic pressure, $S_{ref}$ is aerodynamic reference area, d is an aerodynamic reference length, m is the mass of the missile, $V_m$ is velocity of the missile, $I_{yy}$ is pitch moment of inertia, $C_{m\alpha}$ is moment derivative with respect to angle-of-attack, $C_{n\alpha}$ is a normal force derivative with respect to angle-of-attack, $C_{m\delta}$ is a moment derivative with respect to tail deflection, and $C_{n\delta}$ is a normal force derivative with respect to tail deflection.

* * * * *